US005778637A

United States Patent [19]

Guillonnet

[11] Patent Number: 5,778,637

[45] Date of Patent: Jul. 14, 1998

[54] METHOD FOR FITTING A DEVICE FOR THE OPENING AND CLOSING OF A PACK

[75] Inventor: Michel Guillonnet, Villeurbanne, France

[73] Assignee: International Paper Emballages Liquides Sa-Ipel SA, France

[21] Appl. No.: 816,031

[22] Filed: Mar. 11, 1997

[30] Foreign Application Priority Data

Mar. 20, 1996 [FR] France ..... 96 03702

[51] Int. Cl.[6] ..... B65B 61/18

[52] U.S. Cl. ..... 53/412; 53/410; 53/133.2

[58] Field of Search ..... 53/410, 412, 415, 53/133.1, 133.2, 136.1, 133.8

[56] References Cited

U.S. PATENT DOCUMENTS

| | | | |
|---|---|---|---|
| 3,894,381 | 7/1975 | Christine et al. | 53/410 X |
| 4,184,310 | 1/1980 | Shelby | 53/133.1 X |
| 4,290,253 | 9/1981 | Domke et al. | 53/410 |
| 4,990,200 | 2/1991 | Heinz . | |
| 5,429,699 | 7/1995 | Abrams et al. | 53/133.1 X |
| 5,433,061 | 7/1995 | Hutchinson et al. | 53/133.1 |
| 5,630,308 | 5/1997 | Guckenberger | 53/412 |

FOREIGN PATENT DOCUMENTS

| | | |
|---|---|---|
| .0242720 | 10/1987 | European Pat. Off. . |
| 0398447 | 11/1990 | European Pat. Off. . |
| 0357841 | of 1994 | European Pat. Off. . |
| 0658480 | 6/1995 | European Pat. Off. . |
| 4409945 | 9/1995 | Germany . |
| 746891 | 3/1956 | United Kingdom . |
| 93002923 | 2/1993 | WIPO ..... 53/133.2 |

*Primary Examiner*—Linda Johnson
*Attorney, Agent, or Firm*—Parkhurst & Wendel, L.L.P.

[57] ABSTRACT

A method of producing an aseptic package that is filled with content prior to precutting a weak-spot in a layer of the package. The insertion of content into the aseptic package prior to performing the precutting operation reduces the risk of contamination from cleansing agents.

7 Claims, 2 Drawing Sheets

METHOD FOR FITTING A DEVICE FOR THE OPENING AND CLOSING OF A PACK

BACKGROUND OF THE INVENTION

The invention relates to a method intended for finishing a pack, this finishing essentially involving making an orifice in these packs and fitting an opening and closing device on the said pack.

In the field of packaging, in particular that of liquid products, there have been many developments in the use of cardboard or composite materials employing cardboard.

Many packs of this type are, in particular, in the form of bricks and prove to be especially sought-after whenever the problem of transporting them, storing them and, as a corollary, stacking them arises.

As regards the possible stacking of such packs, many types of opening and closing systems have been proposed. In all cases, the proposed opening and closing systems presuppose the making of a precut in the pack, in particular in its upper face, such that, when the pack is first used, that is to say when it is first opened, the user can easily, strictly speaking, open the said pack so as thereby to gain access to the interior of the pack and, as a corollary, allow the liquid which it contains to be poured out.

Moreover, with a view to optimizing the production rates of these packs, these precuts are carried out directly on the component material of the pack, taking the form of a breadth of material, that is to say upstream of the actual production of the pack.

For this purpose, various devices and methods have been proposed for making such precuts on the breadths of material, such as, in particular, the document EP-A-0,357,841 or EP-A-0,398,447. Such precutting methods employ laser technology and are equipped with sensors intended to make it possible to recognize a repetitively printed pattern, so as to locate very accurately the making of the precut.

As well as these various types of packs based on composite materials, especially on a cardboard/ aluminium/ plastic complex, the plastic being more particularly polyethylene film, methods and devices capable of producing aseptic packs have also been developed.

One of the steps of this method involves subjecting the breadth of material to a sterilization phase by passage through a bath of hydrogen peroxide (oxygenated water), prior to a drying step.

The said material is subsequently shaped into the form of a continuous tube and undergoes permanent filling with the liquid which it is intended to contain, before being cut out in the form of a unit pack. This technique is described, for example, in the document FR-A-2,195,550. In other words, the liquid is introduced into the pack under perfectly sterile conditions.

However, such a filling method presupposes that precuts are made before this sterilization phase. Now in view of the fact that these precuts are made in the component material of the pack, the cardboard, sandwiched in the composite material forming the actual material, comes into contact with the oxygenated water in the region of these precut zones, thus giving rise to a risk of contamination.

An alternative for overcoming this disadvantage has been proposed, involving fitting, on either side of the precut, a local protective film made from polyethylene or from an aluminium/adhesive-film complex, the two protective films thus formed being removed when the pack is first opened. Although the fitting of this film certainly makes it possible to avoid any risk of contamination of the opening zone by the oxygenated water, it entails an additional step in the process for producing the pack and leads to the application of two adhesives in the region of the precut zone, this step proving relatively difficult to execute, in view of the accuracy necessary in locating the adhesive, and time-consuming, finally having a significant adverse effect on the production cost of such packs.

SUMMARY OF THE INVENTION

The object of the invention is to avoid these various disadvantages.

It proposes a method for fitting a device for the opening and closing of a pack of the type in question, which involves first filling the said pack, then subjecting it to the precutting operation, for example by laser, in such a way as to define a zone of lesser resistance, particularly on its upper face, and finally receiving, in the region of this zone, a plug or opening system bonded to the periphery of the said zone of lesser resistance.

In other words, the invention involves carrying out the precutting operation on the actual pack already produced and filled, not on broad sheets of material before being made into a pack as in the prior art.

This avoids any risk of contamination of the component material of the pack in the region of the precut zones, because the material is subjected to a sterilization operation in a peroxide medium. This is a sound material that has not yet undergone any impairment, including by virtue of precutting.

Advantageously, the precutting operation and the operation of fitting the plug are carried out at the same station, at which the filled pack is held by an indexing system.

However, it is equally possible to consider not using such an indexing system, the location of the precutting zone being identified by photoelectric cells.

How the invention can be implemented and the advantages stemming from it will emerge more clearly from the following exemplary embodiment given as a non-limiting indication with reference to the accompanying figures.

DETAILED DESCRIPTION OF THE INVENTION

An installation capable of carrying out the method according to the invention has been shown diagrammatically.

This installation comprises basically a filling machine (1) which is symbolized by a parallelepiped and which is, in fact, a relatively complex machine copiously described in the literature (see, for example, FR-A-2,195,550) and not forming the subject of the present invention.

Figure 1:
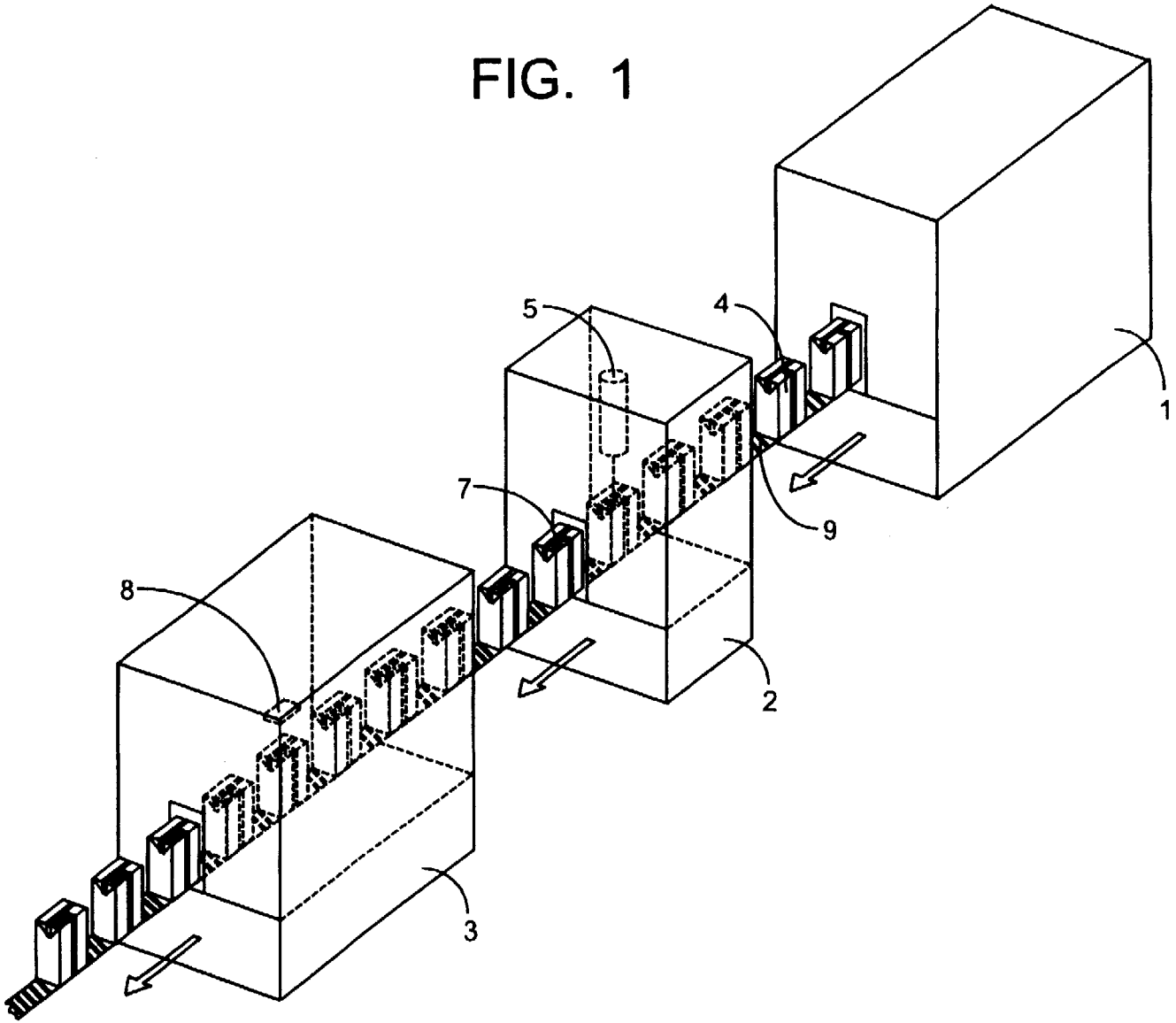
FIG. 1 is a diagrammatic perspective representation of the method according to the invention.
Figure 2A:
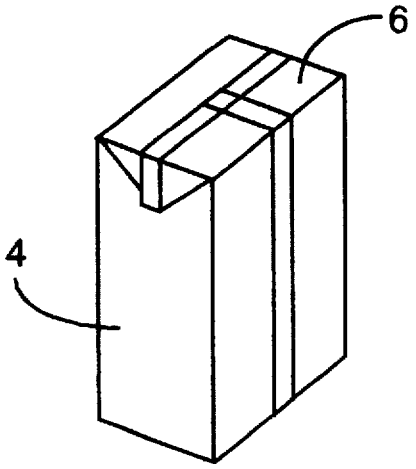
FIG. 2 is a diagrammatic representation of a pack at the exit of a filling machine, respectively 2*a*, after precutting 2*b* and after the fitting of a plug 2*c*.
Figure 2B:
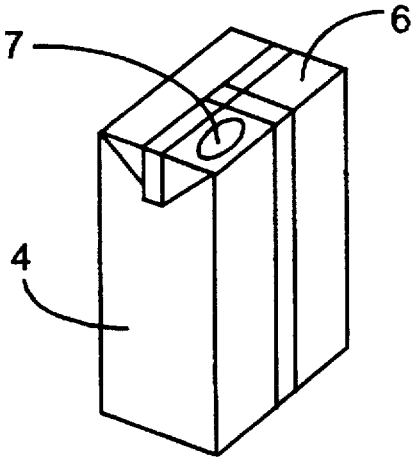
Figure 2C:
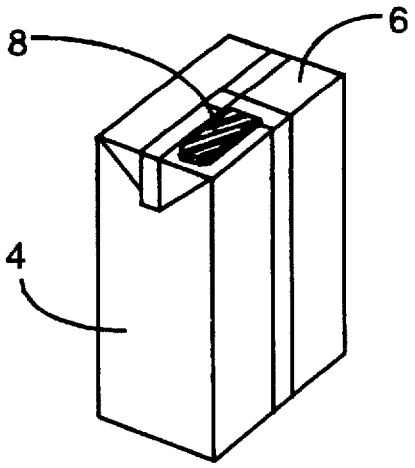

At the exit of this filling machine, that is to say the location in the region of which the packs (4) are, as already specified, filled prior to their formation and cutting-out and folding, the said packs (4) emerge in a unitary manner on a conveyor (9) intended for conveying them into the region of a precutting station (2). This precutting station comprises a laser (5), in particular a $CO_2$ laser, intended for producing, on the upper face (6) of the packs (4), a precut zone (7), for example of elliptic shape, as illustrated in FIGS. 1 and 2*b*. Since the packs arriving at the precutting station (2) are held fixedly, the laser it itself fixed. However, a precutting station is conceivable, in the region of which the laser accompanies the pack at the same speed, itself continuing its advance by means of the conveyor (9), the said laser being driven in a return movement as soon as the precut is made.

Typically, the laser beam is adjusted in such a way that the precut does not pass through the entirety of the composite material forming the pack, but, at the very least, preserves the intactness of the inner lining of the pack, so as to make the latter impervious to light and to ambient air, and consequently aseptic.

The packs thus provided with their precut (7) are then conveyed by means of the same conveyor or another conveyor into the region of the station (3) for fitting the closing and opening plugs (8).

This fitting of the plugs is advantageously fully automated, the said plugs in fact being bonded along the periphery of the precut zone.

Moreover, it is possible to consider carrying out the precutting and plug fitting operations within the same station. Advantageously, the packs at each of these stations are held in place and positioned correctly by means of an indexing system (not shown), thus making it possible to achieve a very high accuracy, on the one hand in the production of the precut zone and on the other hand in the fitting of the opening and closing plugs or systems (8).

The entire process of precutting and of fitting the plug is thus automated, making it possible to preserve the pack production rates already known and obtained by means of filling machines, without thereby impairing the aseptic conditions for producing the materials and consequently the pack. Moreover, the laser used at the precutting station (2) is a standard laser ($CO_2$) which therefore does not require any consequent investment.

The full benefit of such a method can therefore be appreciated, making it possible very simply to avoid the risks inherent in the operation of sterilizing in a peroxide bath.

I claim:

1. A method for fitting an opening and closing device on a pack comprised of composite material comprising the steps of:

filling closing the pack;

precutting the composite material of the filled pack leaving an inner lining intact to create a precut zone on an upper face;

and attaching an opening and closing device over the precut zone.

2. The method for fitting an opening and closing device on a pack according to claim 1, wherein the precutting of the filled pack is performed by a laser.

3. The method for fitting an opening and closing device on a pack according to claim 1, wherein the opening and closing device is bonded along the periphery of the precut zone.

4. The method for fitting an opening and closing device on a pack according to claim 1, wherein the precutting of the filled pack and the attaching of the opening and closing device are performed at a same station.

5. The method for fitting an opening and closing device on a pack according to claim 1, wherein the filled pack is held by an indexing system at a station for precutting and subsequently a station for fitting the opening and closing device.

6. The method for fitting an opening and closing device on a pack according to claim 2, wherein the laser and the filled pack are held fixedly during the precutting.

7. The method for fitting an opening and closing device on a pack according to claim 2, wherein the laser moves in synchrony with the filled pack, the laser returning to a preset position as soon as the precutting of the filled pack is completed.

* * * * *